US007337785B2

(12) United States Patent
Gueret

(10) Patent No.: US 7,337,785 B2
(45) Date of Patent: Mar. 4, 2008

(54) DEVICE AND METHOD FOR APPLYING PRODUCT TO KERATINOUS FIBERS

(75) Inventor: Jean-Louis H. Gueret, Paris (FR)

(73) Assignee: L'Oréal S.A., Paris (FR)

( * ) Notice: Subject to any disclaimer, the term of this patent is extended or adjusted under 35 U.S.C. 154(b) by 1187 days.

(21) Appl. No.: 09/912,367

(22) Filed: Jul. 26, 2001

(65) Prior Publication Data

US 2002/0023658 A1 Feb. 28, 2002

(30) Foreign Application Priority Data

Jul. 26, 2000 (FR) ..... 00 09771

(51) Int. Cl.
*A45D 40/26* (2006.01)

(52) U.S. Cl. ..... 132/218; 15/207.2

(58) Field of Classification Search ..... 132/218, 132/200, 173, 308, 313, 317, 320, 901, 219, 132/120, 126, 156, 135, 137, 138, 139, 141, 132/142, 159, 160, 161, 53; 15/106, 114, 15/159.1, 160, 167.1, 167.3, 207.2; 401/122, 401/129, 268; D4/106, 130, 134, 136
See application file for complete search history.

(56) References Cited

U.S. PATENT DOCUMENTS

| | | | | |
|---|---|---|---|---|
| 1,450,259 | A * | 4/1923 | Nessler | 132/53 |
| 1,905,399 | A * | 4/1933 | Wagner | 132/218 |
| 2,242,743 | A * | 5/1941 | Brown | 15/167.1 |
| 2,317,110 | A * | 4/1943 | Person | 264/243 |
| D187,976 | S * | 5/1960 | Farber | D4/112 |
| 3,026,146 | A * | 3/1962 | Szabo et al. | 300/1 |
| 3,085,273 | A * | 4/1963 | Cowan | 15/167.1 |
| 3,295,156 | A * | 1/1967 | Brant | 15/167.1 |
| 3,343,551 | A * | 9/1967 | Anderson | 132/218 |
| 3,383,157 | A * | 5/1968 | Goldhirsh | 401/190 |
| 3,862,639 | A | 1/1975 | Schefer | |
| 3,871,391 | A * | 3/1975 | Boudal | 132/262 |
| 4,081,876 | A * | 4/1978 | Pugh | 15/167.1 |
| 4,527,575 | A * | 7/1985 | Vasas | 132/218 |

(Continued)

FOREIGN PATENT DOCUMENTS

FR 2700678 A1 * 1/1993

(Continued)

OTHER PUBLICATIONS

Derwent 1994-257082, translated abstract of FR2700678A1, 2 pages.*

*Primary Examiner*—Eduardo C. Robert
*Assistant Examiner*—David Comstock
(74) *Attorney, Agent, or Firm*—Finnegan, Henderson, Farabow, Garrett & Dunner, L.L.P.

(57) ABSTRACT

The present application relates to a device for applying a product to keratinous fibers. The applicator comprises an untwisted support defining a longitudinal axis. A first plurality of bristles is arranged in a first sheet and attached to the support. A second plurality of bristles is arranged in a second sheet and attached to the support. At least some of the bristles arranged in the first sheet intersect with at least some of the bristles arranged in the second sheet when the applicator is viewed substantially perpendicularly to the longitudinal axis.

77 Claims, 6 Drawing Sheets

U.S. PATENT DOCUMENTS

Figure 1:
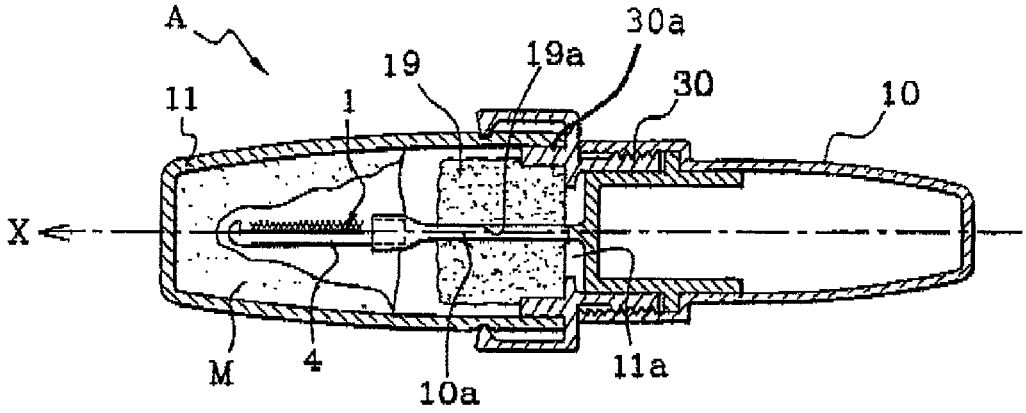

| | | | | | |
|---|---|---|---|---|---|
| 4,609,228 | A | * | 9/1986 | Bickel | 300/4 |
| 4,635,313 | A | * | 1/1987 | Fassler et al. | 15/193 |
| 4,730,361 | A | * | 3/1988 | Koffler | 15/160 |
| 4,776,054 | A | * | 10/1988 | Rauch | 15/167.1 |
| 5,137,039 | A | * | 8/1992 | Klinkhammer | 132/308 |
| 5,414,890 | A | * | 5/1995 | Morando | 15/167.1 |
| 5,450,865 | A | * | 9/1995 | Park | 132/218 |
| 5,474,366 | A | * | 12/1995 | Strutt et al. | 300/21 |
| 5,628,082 | A | * | 5/1997 | Moskovich | 15/110 |
| 5,678,275 | A | * | 10/1997 | Derfner | 15/167.1 |
| 5,709,230 | A | * | 1/1998 | Miraglia | 132/218 |
| 5,865,556 | A | * | 2/1999 | Lhuisset | 401/290 |
| 6,018,840 | A | * | 2/2000 | Guay et al. | 15/207.2 |
| 6,049,934 | A | * | 4/2000 | Discko | 15/106 |
| 6,076,985 | A | | 6/2000 | Gueret | |
| D443,985 | S | * | 6/2001 | Beals et al. | D4/104 |
| 6,260,558 | B1 | * | 7/2001 | Neuner | 132/218 |
| 6,272,714 | B2 | * | 8/2001 | Beals | 15/167.1 |
| 2004/0009964 | A1 | * | 1/2004 | Capelli | 514/184 |

FOREIGN PATENT DOCUMENTS

| | | |
|---|---|---|
| FR | 2 745 272 | 8/1997 |
| JP | 59-48320 | 3/1984 |
| JP | 62-163015 | 10/1987 |
| JP | 9-98836 | 4/1997 |

* cited by examiner

1/6

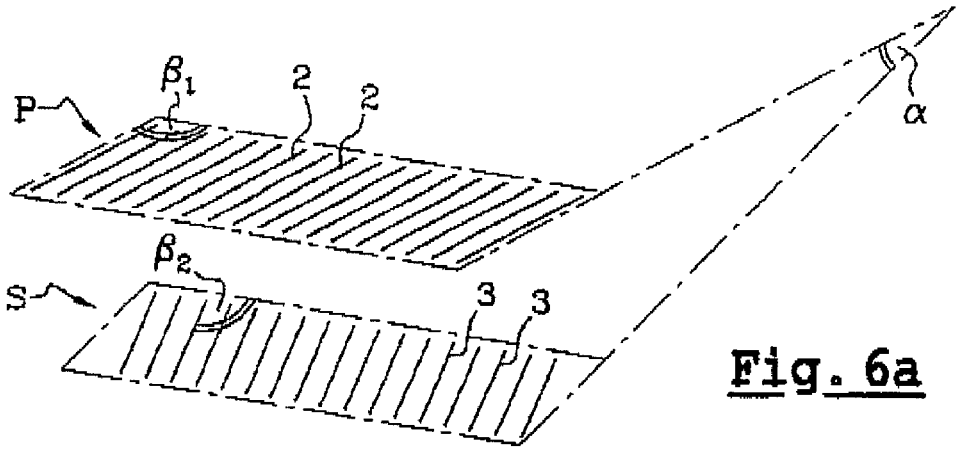
Fig. 6a
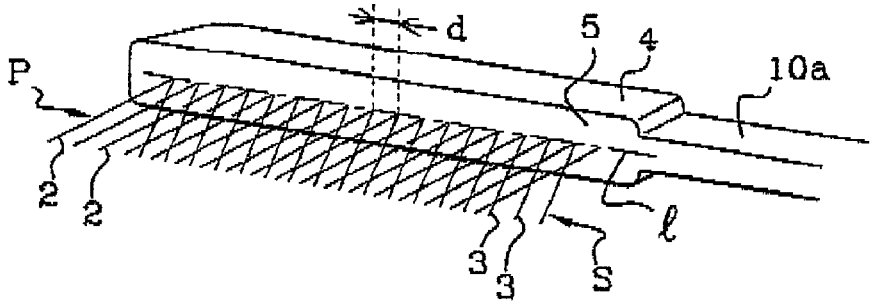
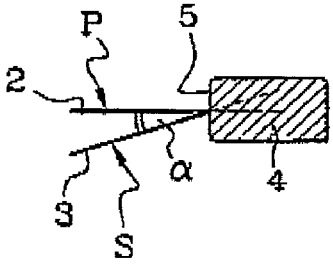
Fig. 6b
Fig. 7a
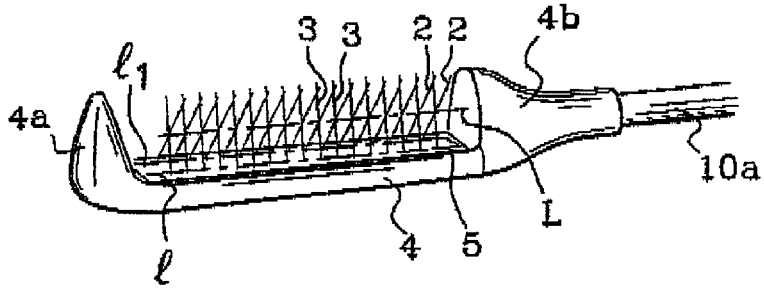
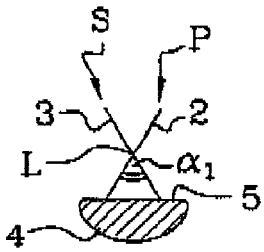
Fig. 7b
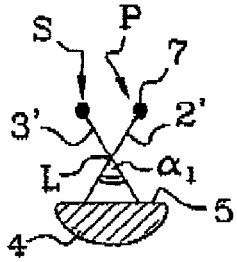
Fig. 7c

DEVICE AND METHOD FOR APPLYING PRODUCT TO KERATINOUS FIBERS

The present invention relates to an applicator for applying a product to keratinous fibers. In particular, the present invention relates to an applicator comprising bristles, which is suited to applying a product for making-up and/or treating the eyelashes or eyebrows.

Packaging and application devices are known in which the application element comprises a comb-type applicator having at least one row of teeth capable of being loaded with product when the applicator is removed from the container containing the product.

In the make-up field, the arrangement of teeth or bristles on an applicator is one parameter for controlling application of the product, for instance, to the eyelashes. For each arrangement of teeth or bristles, for a product having a given rheology, there corresponds a different make-up look. Thus, depending on the arrangement of the teeth or bristles, the product will provide a make-up look of, for instance, a light, a heavy, a curling, or a lengthening type, etc.

Of course, there are other parameters that influence the application characteristics of the product, for instance, the nature of the product itself. As a result, there is an incentive to tailor the applicator to the product according to the type of make-up look desired.

Comb-type applicators are generally obtained entirely by molding, typically by molding a thermoplastic. One of the problems that can arise with such molded combs is the difficulty with proliferating different types of teeth arrangements, and consequently therefore of proliferating different types of make-up looks that can be obtained. This is because each new arrangement of the teeth, for the purpose of obtaining a new make-up look, requires the use of a new mold. Moreover, certain types of arrangements cannot be easily obtained by molding. In addition, the production of teeth having a small cross section, or teeth having a complex shape, can be problematic.

For eyelash make-up products, brushes of the "twisted-brush" type are also known. These twisted brushes comprise a core having two branches of a wire twisted so as to form helical turns. Prior to the step of twisting the wire, a sheet of bristles is inserted between the two branches of the wire. After complete twisting, the bristles extend radially from between the two twisted branches of the wire. The final shape of the brush may then be obtained by trimming the brush to the required profile depending on the desired makeup look.

An inherent drawback of twisted-brush type applicators is that the amount of product held by the applicator, even after wiping, is often greater than the amount required for the application. Consequently, residual product remains, which can dry out between two applications.

Furthermore, certain arrangements of bristles still cannot be obtained using twisted-brush technology. The limitations of the technology are inherent because the bristles must follow, at least at their base, the helical movement of the wire, which supports them.

Hence, one of the optional objects of the invention is to provide an applicator for applying a product to keratinous fibers, which has bristles, or tufts of bristles, arranged in new configurations for the purpose of obtaining new types of make-up looks.

Another optional object of the invention is to provide an applicator that achieves proper spreading of the product over the fibers to be treated.

A further optional object of the invention is to provide an applicator that separates, lengthens, and/or curls the keratinous fibers.

It is another optional object of the invention to produce an applicator which is simple to use and inexpensive to produce.

It should be understood that the invention could still be practiced without performing one or more of the optional objects and/or advantages described above. Still other optional objects will become apparent from the detailed description that follows.

As broadly described herein, the present invention optionally relates to an applicator for applying a product to keratinous fibers, comprising an untwisted support defining a longitudinal axis. A first plurality of bristles is arranged in a first sheet and attached to the support. A second plurality of bristles is arranged in a second sheet and attached to the support. At least some of the bristles arranged in the first sheet intersect with at least some of the bristles arranged in the second sheet when the applicator is viewed along a line of sight substantially perpendicularly to the longitudinal axis.

As broadly used herein, the term "intersect" does not mean or imply that the bristles need actually physically touch each other. Rather, the term "intersect" means that, when viewed from a particular orientation, the bristles will appear to cross over one another. In other words, when viewed from a particular orientation, the traces (i.e. projections of visual images) of the bristles on a plane perpendicular to the line of sight would intersect. Alternatively, the bristles may physically touch one another at the place where they intersect.

Also, as broadly used herein, the phrase "untwisted support" refers to a support wherein the mounting surface of the bristles does not spiral through one or more 360° turns. Thus, a support having a bristle mounting surface that is rotated less than 360° is not considered "twisted."

The term "sheet," as broadly used herein, refers to a substantially two-dimensional structure. The sheet may be planar or curved. Moreover, deviations in the placement of the bristles or tufts of bristles from the two-dimensional aspects of the structure are encompassed by this term.

Accordingly, a keratinous fiber, which is oriented substantially transversely to the axis of the applicator and brought into engagement with the applicator, may be held between two intersecting bristles. These bristles may be separated in a direction transverse to the longitudinal axis X of the applicator by a distance, which is less than the length of the fiber and that, optionally, may be approximately zero.

The term "attached" refers to the bristles being separately manufactured, upstream of the applicator manufacturing process, and then set into the applicator during manufacture of the support or after manufacture of the support.

Thus, the bristles may be obtained in any conventional manner, for instance, by extrusion through a die and then by cutting to the required length. The bristles may furthermore be subjected to various treatments, for example chemical, thermal or mechanical treatments. The bristles may then be set into the support, for example, by overmolding or injection-overmolding of the support onto the bristles, which have one end placed in the mold. Optionally, the bristles may be attached after the support has been molded, for example by adhesive bonding, hot- or cold-swaging, stamping, riveting, welding, or stapling.

The bristles may be made of a material identical to or different from the material forming the support. By way of example, the bristles may be made of nylon 6, nylon 6-6, nylon 6-10, nylon 6-11, or nylon 6-12. The support may be made of a relatively rigid thermoplastic. By way of example, the support may be made of a polyethylene, a polypropylene, or an elastomer.

The product applied by the applicator may be a cosmetic product, in particular a product for treatment of the eyelashes or eyebrows. One such product is a mascara composition, which may have a relatively viscous consistency. The purpose of such a composition, when applied to the eyelashes, may be to color, lengthen, and/or curl the eyelashes. The composition may also have other treatment effects.

According to one optional aspect, the bristles are arranged, at least partly, within the first and second sheets to form tufts. Such a tuft may comprise approximately 2 to approximately 200 bristles, or as a first alternative, approximately 4 to approximately 100 bristles, or as a second alternative, approximately 5 to approximately 50 bristles.

According to an optional aspect of the invention, the bristles of the first and second sheets may intersect at a first distance from their free ends. Thus, because of the crossed configuration of the bristles, the bristle portions located between the point of intersection and the free end of the bristles define V-shaped recesses or forks. These V-shaped recesses may be capable of gripping the keratinous fibers, such as eyelashes, and promoting the spread of the product thereon when the applicator, loaded with product, is brought into engagement with the eyelashes. Furthermore, such "gripping" may allow the product to be spread right to the extreme tip of the eyelashes, and consequently may provide the illusion of longer eyelashes. In addition, by extending the application movement with a rotational movement about the axis of the applicator, the eyelashes gripped within the V-shaped recesses may be curled.

In another optional aspect of the invention, the bristles of the first sheet may intersect with the bristles of the second sheet when the applicator is viewed along its longitudinal axis. In other words, not only may the bristles of one sheet be crossed over the bristles of the other sheet (as best viewed substantially perpendicularly to the longitudinal axis of the applicator), but also the sheets themselves may intersect one with respect to the other (as best viewed along the longitudinal axis of the applicator).

Optionally, the first and second sheets may be parallel to each other. Thus, the bristles or tufts of bristles of one sheet may be set into the support in a line of setting parallel to the line of setting of the bristles or tufts of bristles of the other sheet.

Also optionally, the first and second sheets may be arranged so as to be a non-zero distance apart. However, according to another optional embodiment, the first and second sheets maybe in contact, or substantially in contact, with each other. Such a configuration may facilitate the engagement of the fibers to be treated by the V-shaped recesses, as mentioned above.

According to another optional aspect of the invention, the first and second sheets may not be parallel to each other. Thus, the bristles or tufts of bristles of one sheet may be set into the support in a line of setting not parallel to the line of setting of the bristles of tufts of bristles of the other sheet.

Furthermore, the first and second sheets may be arranged in planes perpendicular to a plane of setting or mounting surface of the bristles in the support.

Alternatively, the first and second sheets may be arranged in planes that are oriented obliquely with respect to the mounting surface of the bristles in the support.

Also alternatively, one of the sheets may be arranged in a plane perpendicular to the mounting surface of the bristles, while the other may be arranged in a plane that is oblique with respect to the mounting surface of the bristles.

Thus, the first sheet may diverge from the second sheet, such that the two sheets form an included angle. The term "diverge" refers to the distance between the first and the second sheets at the mounting surface being less that the distance between the first and second sheets at the free ends of the bristles. The included angle may be, for instance, less than 60°.

The first sheet, optionally, may converge towards the second sheet. The term "converge" refers to the distance between the first and the second sheets at the mounting surface being more that the distance between the first and second sheets for at least some portion of the distance spaced from the free ends of the bristles. In this configuration, the first and second sheets may intersect, when viewed along the longitudinal axis of applicator. The first sheet may define an angle of intersection with the second sheet that may vary from approximately 15° to approximately 165°. The first and second sheets may intersect a first distance from the free end of the bristles arranged within the first and second sheets. In this way, other V-shaped recesses or forks may be formed between the bristles, and the keratinous fibers may engage the bristles at the bottom of these recesses.

According to another optional embodiment of the invention, the applicator may comprise a third plurality of bristles arranged in a third sheet. According to one optional embodiment of a three-sheet applicator, two sheets are substantially mutually parallel and at least one additional sheet is arranged so that it intersects with one or both of the two mutually parallel sheets.

According to another optional aspect, the plurality of bristles within a given sheet may be substantially parallel to each other. Alternatively, certain bristles of the sheet may be in a first orientation within the sheet, while other bristles of the same sheet may have a different orientation.

Likewise, the plurality of bristles within a given sheet may have a constant bristle density over the entire length of the sheet or a variable bristle density. Thus, for instance, near the free end of the applicator, the sheets may be provided with a region having a higher bristle density so as to make it easier to apply make-up to the lower eyelashes or the eyelashes near the corner of the eye.

According to another optional aspect, the first and second sheets may have different heights over at least part of their axial length. In this way, the bristles of the taller sheet may provide a more pronounced eyelash combing and separating function.

According to yet another optional aspect, at least one of the sheets may have a height, which can vary, for example progressively, over at least part of its axial length. The free edge of the sheets may be adapted to the desired radius of curvature of the eyelashes on the eyelids.

According to one particular optional embodiment of the present invention, the support comprises at least two parts. These parts may be linked by a film hinge, around which the two parts may be relatively pivoted and brought together. Optionally, the parts may be joined together by, for instance, snap-fastening, welding or adhesive bonding, so as to form an arrangement of bristles. The film hinge may have an orientation perpendicular or parallel to the longitudinal axis of the applicator.

These parts may also be designed such that the final bristle arrangement is formed only after these parts have been joined together. Thus, for example, a first part may carry a first sheet of bristles, while the second part may carry a second sheet of bristles. Joining these two parts together forms the desired final arrangement of bristles, that is to say, an arrangement comprising two sheets whose bristles intersect.

According to another optional embodiment of the invention, at least one of the sheets may pass through the support and extend from two side of the support. For this purpose, the support may be drilled with a multitude of holes, which are not perpendicular to the mounting surface of the bristles in the support. The bristles may be inserted into the holes and, optionally, fixed in the holes, for instance by adhesive bonding, hot- or cold-swaging, stamping, riveting, welding or fastening, etc. In this way, two application portions, which may be identical or different, may be obtained on two sides of the support. Each application portion may impart different application characteristics when it is brought into engagement with the fibers to be treated.

In order to facilitate and consolidate the setting of the bristles in the support, the bristles may comprise asperities. The asperities may be formed at least on that part of the bristles intended to be set into the support, and may be particularly desired when the support and the bristles are made of different and mutually incompatible materials. As an example, mutually incompatible materials may be materials incapable of creating physico-chemical bonds between them during heat-fusing, overmolding or injection overmolding of the support around the bristles.

Within the plane of the sheet that contains the bristles, the bristles may be inclined with respect to the mounting surface of the support. This angle of inclination may vary from approximately 30° to approximately 150°. Moreover, the angle made by the bristles of one sheet may be different from the angle made by the bristles of the other sheet. Thus, when the applicator is observed from the side (i.e., transverse to the longitudinal axis), the bristles of one sheet intersect with the bristles of the other sheet.

Optionally, the bristles of one sheet may be oriented at an angle of less than 90° with respect to the mounting surface support, whereas the bristles of the other sheet may be oriented at an angle of more than 90° with respect to the mounting surface of the support.

Also optionally, the bristles of one sheet may be inclined symmetrically with respect to the bristles of the other sheet. Thus, the bristles of one sheet may be oriented at $90°-\eta$, whereas the bristles of the other sheet may be oriented at an angle of $90°+\eta$. By way of non-limiting example, the angle $\eta$ may be less than or equal to 60°.

The bristles themselves may be chosen from both natural or synthetic bristles. For example, synthetic bristles may be made of polyethylene, polypropylene, ethylene/propylene copolymer, polyamide, polyester, polyvinyl chloride, polytetrafluoroethylene, polyethylene terephthalate, or thermoplastic elastomer. The plurality of bristles may comprise a mixture of synthetic and/or natural bristles.

The bristles for a device may also comprise bristles of various cross sections. For example, the cross sections of the individual bristles may be hollow, flat or polygonal shaped. The individual bristles may be formed of elastomers and/or the bristles may have at least one capillary groove. Furthermore, the individual bristles may be twisted about their longitudinal axis, to the right or to the left. The bristles may have a circumscribed cross section, i.e., a cross section lying within a circle, wherein the diameter of the circle ranges from approximately 0.06 mm to approximately 0.30 mm, or alternatively from approximately 0.08 mm to approximately 0.20 mm.

Also optionally, the bristles may have free ends that have been ground, and/or free ends that have a rounded shape, a tapered shape, a forked shape, a pinheaded shape, or a hooked shape. The individual bristles may also be of various lengths.

Additionally, the bristles may incorporate fillers, for instance, bacteriostatic fillers, magnetic fillers, and/or fillers capable of improving slip. Furthermore, the bristles may be flocked. The bristles may also comprise a combination of any of the above-described bristles options.

The agents intended to improve the slip of the bristles over the keratinous fibers to be treated may, for example, be chosen from graphite, molybdenum disulphide, or polytetrafluoroethylene.

In one optional aspect, the visible length of the bristles, i.e., the length of the bristles between the mounting surface of the support and the free end of the bristles, may range from approximately 0.5 mm to approximately 20 mm, or from approximately 1 mm to approximately 10 mm.

The applicator may be obtained by overmolding or injection overmolding the support made of a suitable material around one of the ends of the bristles. Depending on the desired make-up characteristics, the support may be made of a rigid, semi-rigid or flexible thermoplastic, for example an elastomer having a suitable flexural modulus.

According to another optional aspect of the invention, an applicator device is provided. The applicator device comprises an applicator, such as any one of the applicators described herein, an element having a gripping surface, and a wand having a first end coupled to the element and a second end coupled to the applicator.

The element may be configured to reversibly close an opening of a container.

According to another optional aspect of the invention, a system for applying a product to keratinous fibers is provided. The system may comprise an applicator device and a container for containing the product.

The container may define an opening and, furthermore, the container may comprise a wiping member located adjacent the opening.

The system may also comprise a cosmetic product for applying to at least one of the eyelashes and the eyebrows, for instance, mascara.

According to even another optional aspect of the invention, a method for applying a product is provided. The method may comprise providing the system, providing the product, loading the product onto the applicator, and placing the applicator in contact with a keratinous fiber such that at least some of the product is applied to the fiber.

The term "providing" is used broadly herein, and refers to, but is not limited to, making available for use, giving, supplying, obtaining, getting a hold of, acquiring, purchasing, selling, distributinge, possessing, making ready for use, and/or placing in a position ready for use.

The method may also comprise engaging the keratinous fiber in a V-shaped fork formed by the intersection of a bristle from the first sheet and a bristle from the second sheet. Optionally, the method may further comprise flexing the bristles forming the intersection. Additionally, the first plurality of bristles may have a height greater than the height of the second plurality of bristles, and the method may comprise drawing the keratinous fiber past the first plurality of bristles so as to separate the keratinous fiber from adjacent keratinous fibers.

The applicator may be fastened to a gripping element to which it is linked directly or by means of a wand.

A wiping member may optionally be provided in the container so that, when the application element is extracted, the product may be distributed over the applicator and/or any excess product may be removed. A suitable wiping member is described, for example, in FR 2 745 272.

The application assembly of the invention can be used for the making-up and/or treatment of the eyelashes or eyebrows.

Besides the structural arrangements and procedural aspects described above, there could comprise a number of other arrangements, such as those explained hereinafter. It is to be understood that both the foregoing description and the following description are exemplary.

Figure 2A:
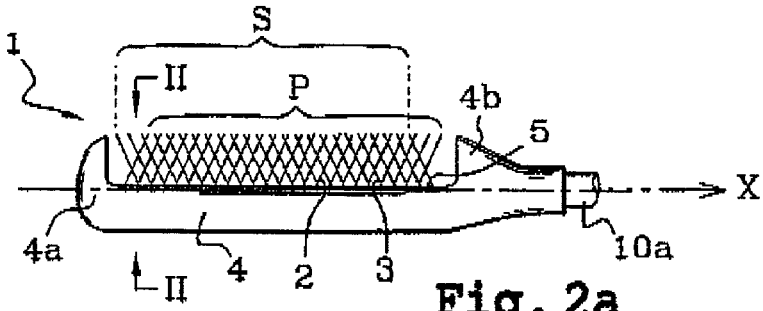
Figure 2B:
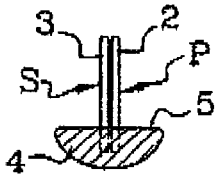
Figure 2C:
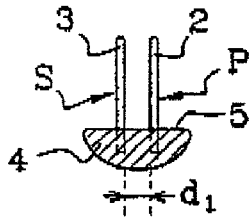
Figure 2D:
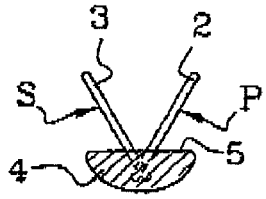
Figure 3A:
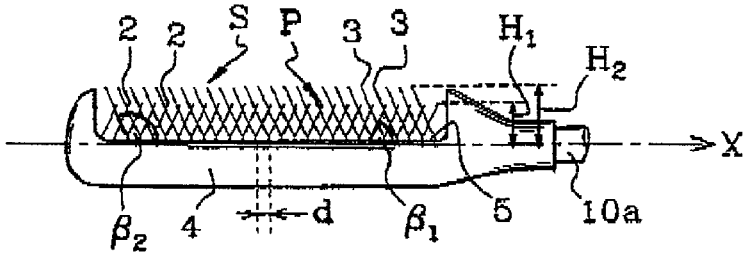
Figure 3B:
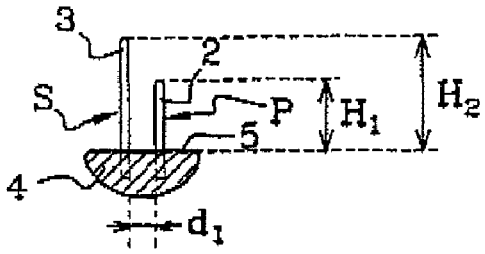
Figure 4:
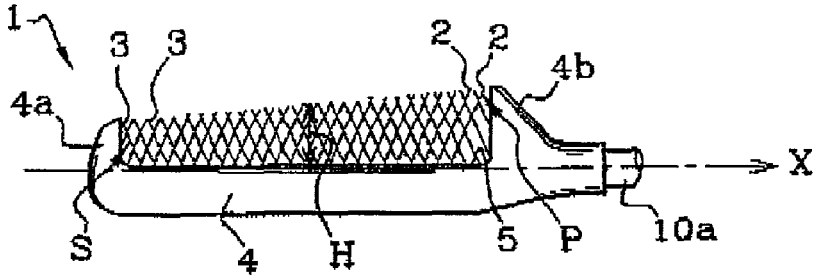
Figure 5A:
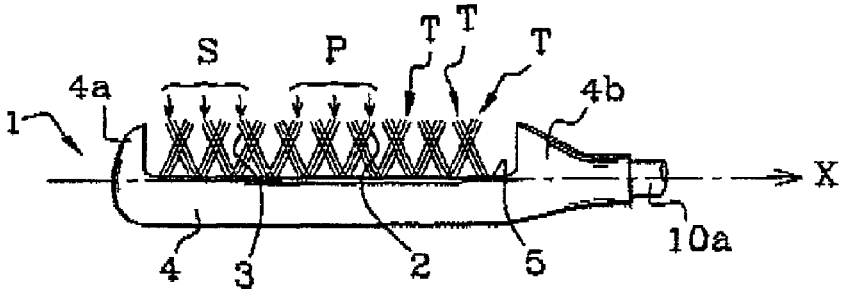
Figure 5B:
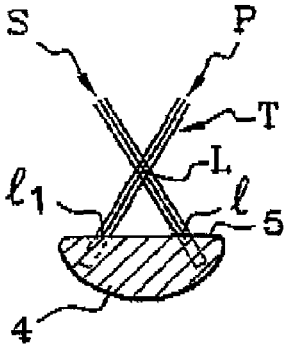
Figure 5C:
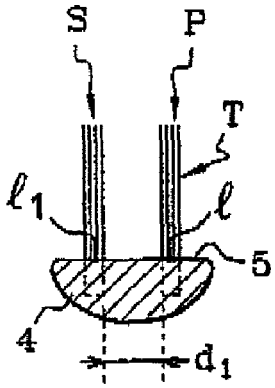
Figure 5D:
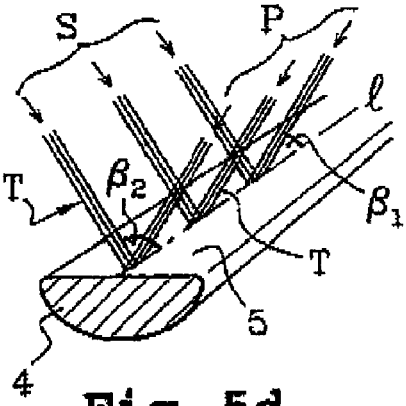
Figure 8A:
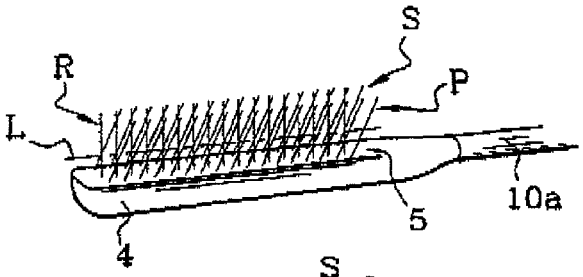
Figure 8B:
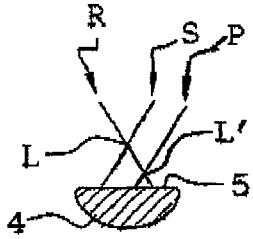
Figure 9:
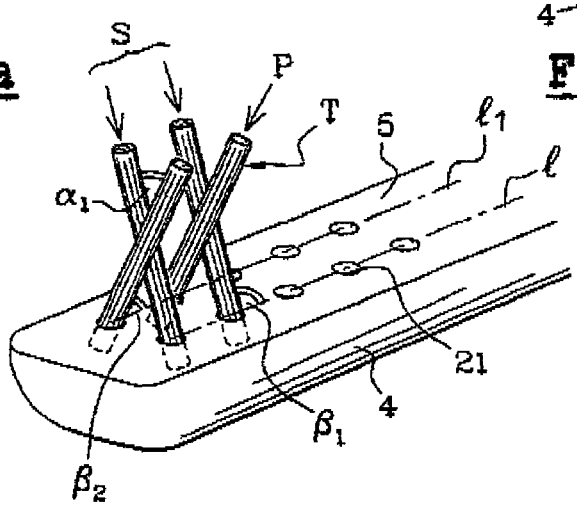
Figure 11:
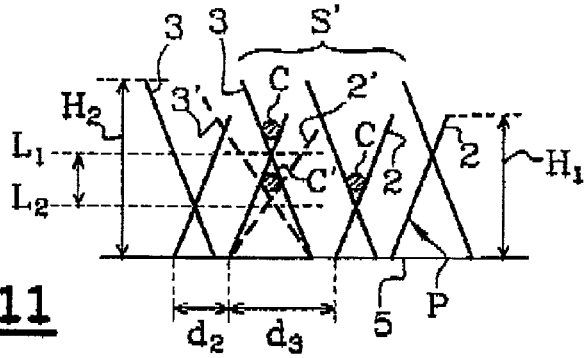
Figure 12:
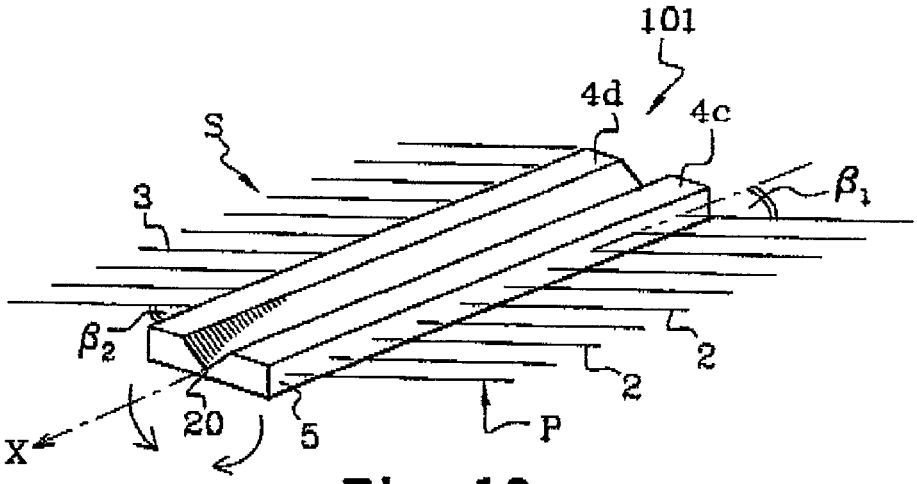
Figure 13A:
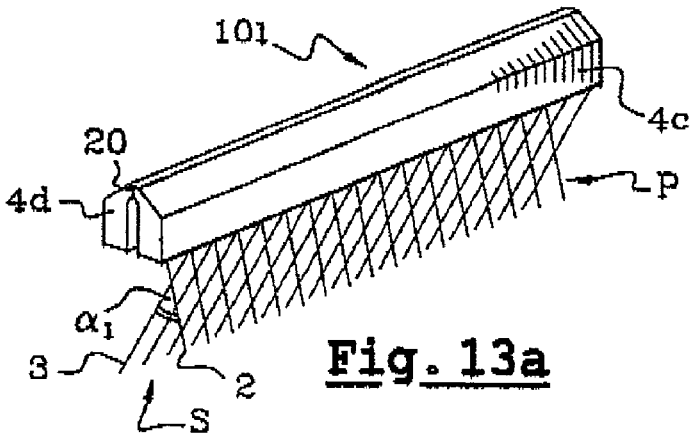
Figure 13B:
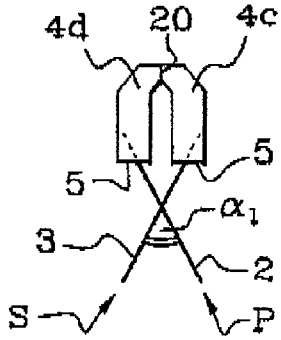
Figure 14A:
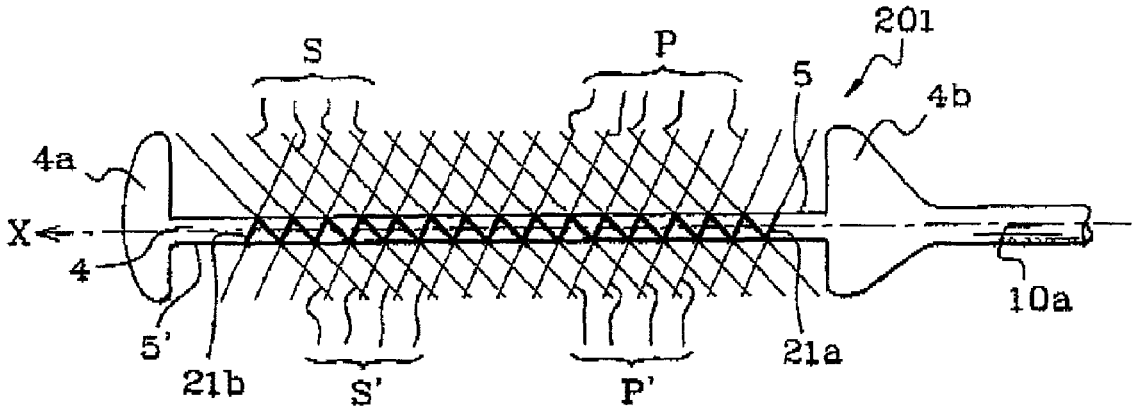
Figure 14B:
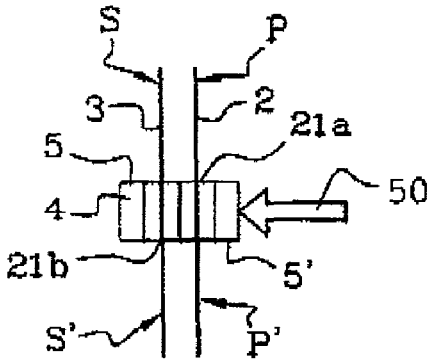

The accompanying drawings are incorporated in and constitute a part of this specification. The drawings illustrate optional embodiments of the invention. In the drawings:

FIG. 1 schematically illustrates in an cross-sectional side view, one optional embodiment of a system equipped with an applicator device according to the invention;

FIG. 2*a* illustrates a side view of an applicator device according to an optional embodiment of the invention;

FIGS. 2*b* to 2*d* illustrate cross-sectional axial views of various alternative forms of an applicator device according to optional embodiments of the invention;

FIGS. 3*a* and 3*b* illustrate side and cross-sectional axial views, respectively, of an applicator device according to an optional embodiment of the invention;

FIG. 4 illustrates a side view of an applicator device according to an optional embodiment of the invention;

FIGS. 5*a* to 5*d* illustrate side, cross-sectional axial, and partial perspective views, respectively, of various alternative forms of an applicator device according to optional embodiments of the invention;

FIGS. 6*a* and 6*b* schematically illustrate partial perspective and cross-sectional axial views of an applicator device according to an optional embodiment of the invention;

FIGS. 7*a* to 7*c* relate to an applicator device according to an optional embodiment of the invention;

FIGS. 8*a* and 8*b* illustrate an applicator device according to an optional embodiment of the invention;

FIG. 9 illustrates a partial perspective view of an applicator device according to an optional embodiment of the invention;

FIGS. 10*a* to 10*f* illustrate various optional ways of setting the bristles in the support of an applicator device according to optional embodiments of the invention;

FIG. 11 schematically illustrates the holding of the eyelashes by the bristles of an applicator device according to an optional embodiment of the invention;

FIGS. 12, 13*a* and 13*b* illustrate various perspective and end views of an applicator device according to an optional embodiment of the invention; and FIGS. 14*a* and 14*b* schematically illustrate an applicator device according to an optional embodiment of the invention.

In the drawings, the dimensions, particularly the spaces between the applicator elements, have been deliberately exaggerated to make the drawings easier to understand.

Reference will no be made in detail to optional embodiments of the invention, examples of which are illustrated in the accompanying drawings. Whenever possible, the same reference numbers or letter designations are used in the drawings and the description to refer to the same or like parts.

Referring to FIG. 1, a packaging and applicator unit or system A equipped with an applicator device 1 according to an optional embodiment of the invention is depicted. The system A comprises an applicator device 1 and a container 11, which contains a reserve of a cosmetic and/or treatment product M for the eyelashes or eyebrows. For instance, product M may comprise a mascara composition having, optionally, a relatively viscous consistency.

The container 11 may be provided with a threaded neck 30 to which an applicator 1 in accordance with the invention may be removably coupled. The applicator 1 may be joined to a gripping sleeve 10 by means of a wand 10*a* aligned along axis X. The gripping sleeve 10 furthermore comprises a cap for closing the container, which may be designed to be screwed onto the neck 30. The threaded neck 30 defines an orifice 11*a* through which the wand 10*a* may be passed when inserted into the container 11.

The orifice 11*a* of the container 11 may be provided internally with a wiping member 19 comprising, for instance, a block of elastically deformable open-cell or semi-open-cell foam. The wiping member 19 may be inserted into an inner portion 30*a* of the neck 30. The wiping member 19 comprises a central passage 19*a* through which the applicator 1 and a portion of the wand 10*a* integral therewith can pass. When the applicator 1 is being removed from the container, the passage 19*a* may allow, and possibly may facilitate, the product M to be spread between and/or on the bristles of the applicator 1. The movement of the applicator 1 through the passage 19*a* may also allow the removal of any excess product M.

Alternatively, the wiper may comprise an annular lip formed by a sleeve made of an elastomeric or a non-elastomeric material and fitted into the neck of the container.

The wand 10*a* may be rigid or semi-rigid. The wand 10*a* has been illustrated as being straight, but it could, as a variant, be curved.

The applicator 1, as illustrated in FIG. 2*a*, comprises a support 4 of elongate shape extending along the longitudinal axis X. The support 4 has a mounting surface or setting 5 into which first and second groups of attached bristles 2, 3 may be fixedly arranged in the form of two sheets P, S. The support 4 has two end portions, a front end portion 4*a* and a rear end portion 4*b*. These end portions may have a height corresponding approximately to the height of the adjacent bristles. The front portion 4*a* may be rounded so as to avoid any sharp angles and, for instance, to lessen the risk of injury to the eye during application. The rear portion 4*b* may be joined to a first end of the wand 10*a*. The second end of the wand 10*a* may be integral with, or fixedly attached to, the gripping sleeve 10 (not shown in FIG. 2*a*).

Each group of bristles 2, 3 may be arranged in a first sheet P and a second sheet S, respectively. The bristles within each sheet P, S may be arranged so that when the applicator is viewed substantially perpendicularly to the longitudinal axis X (as shown in FIG. 2*a*) the bristles 2 of the first sheet P intersect with, e.g., cross over, the bristles 3 of the second sheet S.

FIG. 2*b* illustrates, in a cross-section taken at plane II-II of FIG. 2*a*, an optional embodiment of the applicator 1 for applying a product, for instance, applying a mascara to the eyelashes or eyebrows. As seen in FIG. 2*a*, the first sheet P formed by the bristles 2 may be parallel to the sheet S formed by the bristles 3. The bristles of the first sheet P may touch, or almost touch, the bristles of the second sheet S. In other words, the distance separating the two sheets P and S may be substantially zero.

FIG. 2*c* illustrates an arrangement of the sheets P, S similar to the arrangement of the sheets in FIG. 2*b*, except that the sheets P, S are placed a certain distance apart. Thus, the bristles 2 of the first sheet P are not in contact with the bristles 3 of the second sheet S. As an example, the distance separating the two sheets may be about 1 mm to 1.5 mm.

As shown in FIG. 2*d*, a plane containing the first sheet P diverges with respect to a plane containing the second sheet S. According to the illustrative example considered here, at the surface of the setting 5 of the support 4, the bases of the bristles 2 of the first sheet P are located at some distance from the bases of the bristles 3 of the second sheet S. Alternatively, the bases of the bristles 2, 3 of the first and second sheets P, S could be touching each other at the surface of the setting 5.

FIGS. 3*a* and 3*b* show an optional embodiment in which two bristle sheets P, S may be parallel and comprise different heights $H_1$, $H_2$, respectively. The first sheet P may have a constant height $H_1$, which is less than the height $H_2$ of the second sheet S. Such an arrangement may favor good separation of the eyelashes when applying the product.

The bristles 2 of the first sheet P may be set in the setting 5 at an angle $\beta_1$, and this angle may be different than the angle $\beta_2$ at which the bristles 3 of the second sheet S may be set. Optionally, the angles $\beta_1$, $\beta_2$ may range from approximately 30° to approximately 150°. For example, the angle $\beta_1$ may be less than 90° and the angle $\beta_2$ may be equal to or greater than 90°, or vice versa. According to another example, $\beta_1$ may be about 70° while $\beta_2$ may be about 110°, so that the bristles 2 of the sheet P make an angle of around 40° with respect to the bristles 3 of the sheet S.

Optionally, the sheets P, S of FIG. 3*a* may be arranged as generally illustrated in FIGS. 2*b*, 2*d* and 7*b*. The sheets P, S may be set such that they touch, or almost touch; they may be set a certain distance apart, for instance a constant distance $d_1$, at the surface of the setting 5, or they may be set non-parallel.

The sheets P, S formed on the applicator illustrated in FIG. 4 have a variable height H, for instance, a height which progressively increases from the free end 4*a* of the applicator 1 towards the wand 10*a*. Optionally, the profile defined by the free ends of the bristles 2, 3 may be straight, curved, concave, or convex.

In accordance with another optional embodiment of the invention, FIGS. 5*a* to 5*d* show, in a similar way to FIGS. 2*a* to 2*d* and 7*b*, an applicator 1 comprising tufts T of bristles 2, 3 instead of isolated bristles. Thus, a first sheet P may be defined by tufts of bristles 2, while a second sheet S may be defined by tufts of bristles 3. A tuft T of bristles 2, 3 may comprise from 2 to approximately 200 bristles, preferably approximately 4 to approximately 100 bristles and more particularly approximately 5 to approximately 50 bristles.

FIGS. 6*a* and 6*b* illustrate a method of setting two sheets P, S of bristles 2, 3 into the support 4 along a single line of setting l. The sheets P and S may be oriented so as to diverge from each other. An angle of divergence a may vary from approximately 5° to approximately 45°. In the optional embodiment illustrated, one of the sheets P may be oriented perpendicular to the surface of the setting 5 of the support 4. The other sheet S may be oriented obliquely with respect to the surface of the setting 5. The angles $\beta_1$ and $\beta_2$ of orientation of the bristles 2, 3 within each of the sheets P, S may be as defined above.

FIGS. 7*a* to 7*c* illustrate an applicator 1 having a setting 5 in which first and second sheets P, S are set. The plane of the sheet P may intercept the plane of the sheet S along a line L, which is parallel to the axis X of the applicator 1 and parallel to the surface of the setting 5. The plane of the sheet P makes an angle $\alpha_1$ with the plane of the sheet S. The line of setting l of the sheet P may be parallel to the line of setting $l_1$ of the sheet S. The respective lines of setting may be a non-zero distance apart at the surface of setting 5. The line of intersection L lies a certain distance from the free end of the bristles 2, 3.

FIG. 7*c* shows that the free end of the bristles 2, 3 may be rounded or shaped in the form of a pinhead 7, for example, by a heat treatment. In general, the free ends of the bristles may be subjected to any of various mechanical, thermal or chemical treatments.

FIGS. 8*a* and 8*b* illustrate perspective and cross-sectional views, respectively, of an optional embodiment in which the applicator 1 has three sheets P, R, S of bristles. According to this optional embodiment, two sheets P, S may be mutually parallel and set obliquely with respect to the surface of the setting 5. The third sheet R may be arranged with respect to the surface of the setting 5 such that the plane that contains sheet R cuts the plane of the sheet P along a first line of intersection L' and cuts the plane of the sheet S along a second line of intersection L. The line L' may be parallel to the axis X and parallel to the surface of the setting 5, and the line L may be parallel to the line L'. The first line of intersection L' may be located at a certain distance from the surface of the setting 5, which may be less than the distance separating the surface of the setting 5 from the line L.

FIG. 9 illustrates a partial perspective view of an optional embodiment similar to the optional embodiment shown in FIG. 7*a*. In the embodiment of FIG. 9, the individual bristles 2, 3 shown in FIG. 7*a* have been replaced by tufts T comprising a plurality of bristles.

Figure 10A:
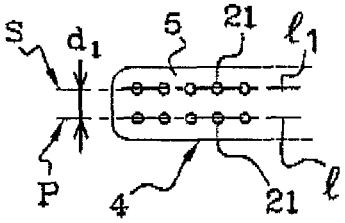

FIGS. 10*a* to 10*d* illustrate various ways of setting the bristles in the setting 5. Setting holes 21 may be arranged in different ways in the support 4. As shown in FIG. 10*a*, the holes 21 are arranged in two parallel lines of setting l, $l_1$. One line of setting l corresponds to the first sheet P and the other line of setting $l_1$ corresponds to the second sheet S. The two lines of setting l, $l_1$ may be separated by a distance $d_1$. The holes 21 of the line of setting l may be arranged opposite the holes of the other line of setting $l_1$.

Figure 10B:
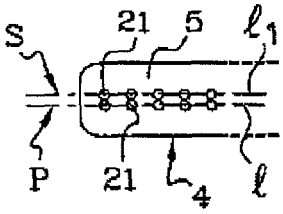

As shown in FIG. 10*b*, the holes 21 may be arranged in two parallel lines of setting l, $l_1$, corresponding to the first sheet P and to the second sheet S, respectively. The holes 21 of each line of setting may be arranged opposite the holes of the other line of setting. According to this optional embodiment, the two lines of setting are arranged at approximately a zero distance apart.

Figure 10C:
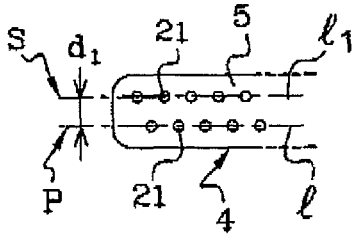

As shown in FIG. 10*c*, the holes 21 may be arranged in two parallel lines of setting l, $l_1$, which also correspond to the first sheet P and to the second sheet S, respectively. The two lines of setting l, $l_1$ may be separated by a non-zero distance $d_1$. Moreover, the holes 21 of the line of setting l may be offset with respect to the holes of the other line of setting $l_1$.

Figure 10D:
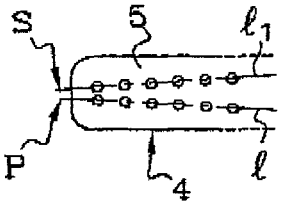

As shown in FIG. 10*d*, the holes 21 are arranged in two lines of setting l, $l_1$, which diverge in the plane of setting 5. The holes 21 of each line of setting are arranged opposite the holes of the other line of setting at a distance that varies progressively.

Figure 10E:
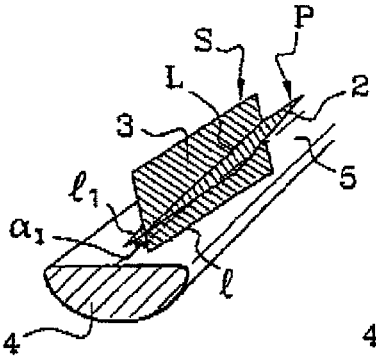

FIG. 10*e* schematically illustrates the arrangement of two sheets P, S set in the configuration of FIG. 10*d*, wherein the sheets P, S are oriented at an angle with respect to each other, so as to intersect along a line L. The line of intersection L may be not parallel to the plane of setting 5.

Figure 10F:
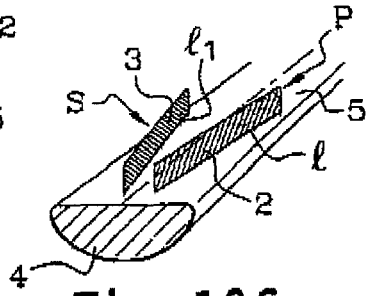

FIG. 10*f* schematically illustrates the arrangement of two sheets P, S set in the configuration in FIG. 10*d*, wherein the sheets P, S are oriented in planes perpendicular to the plane of setting 5.

FIG. 11 schematically illustrates a side view of the bristles of an applicator of the type illustrated in FIGS. 2*a* and 2*b* engaging eyelashes C. Eyelashes C are illustrated oriented substantially perpendicularly to the sheets P, S. The bristles 2, 3 are not arranged equidistantly in the plane of setting 5. Rather, in the same sheet, sheet P for example, the bases of the bristles 2 are separated by variable distances $d_2$, $d_3$. Thus, two lines of intersection $L_1$, $L_2$ located at different heights with respect to the plane of setting 5 are defined. The lines $L_1$ and $L_2$ are located at a certain distance from the free end of the bristles. The ends of a pair of bristles 2, 3 form V-shaped forks in which the eyelashes C may be held or engaged. The bristles may be arranged such that individual eyelashes C may be inserted into the V-shaped forks, resulting in eyelashes that are well separated.

Optionally, bristles may be chosen having a flexibility such that, when an eyelash is brought into contact with two bristles 2, 3 forming a V-shaped fork, the bristles can flex slightly. This flexing is illustrated in FIG. 11 by the dotted lines. Having lines of intersection at different heights and using bristles capable of flexing during application of the product may improve smoothing of the product and better coloring of the eyelashes. Homogeneous spreading of the product, better curling of the lashes and appreciable lengthening of the latter may also be obtained.

According to another optional embodiment of the invention, as illustrated in FIGS. 12, 13*a* and 13*b*, an applicator 101 comprises a support comprising a first part 4*c* and a second part 4*d* of elongate shape. The two parts 4*c* and 4*d* lie on each side of an axis X. The two parts 4*c* and 4*d* may be joined together by a film hinge 20 lying along the axis X.

The bristles 2 form a first sheet P fastened to the part 4*c*. Similarly, the bristles 3 form a second sheet S fastened to the part 4*d*. The bristles 2, 3 are set into the parts 4*fc*, 4*d*, respectively, so that the bristles 2 of the first part 4*c* make an angle $\beta_1$ with the first part 4*c*, this angle being different from an angle $\beta_1$ made between the bristles 3 and the second part 4*d*.

The film hinge 20 makes it possible to manufacture the applicator 101 in the configuration illustrated in FIG. 12 and to assemble the two parts 4*c*, 4*d* by pivoting about the axis X of the film hinge. The pivoted parts 4*c*, 4*d* obtain an applicator in its operating configuration as shown in FIGS. 13*a* and 13*b*.

The two parts 4*c* and 4*d* may be held in their folded position, one with respect to the other, when inserting the applicator into a bore formed by the free end of a wand (not shown in FIGS. 13*a* and 13*b*), which is intended to accommodate the applicator 101. Alternatively, after the two parts 4*c*, 4*d* have been brought together by pivoting about the axis of the film hinge 20, the first part 4*c* may be fixed to the second part 4*d* by, for example, adhesive bonding, welding or snap-fastening means.

With regard to the configuration of the bristles resulting from the assembly of the two parts, an applicator of the type described above with reference to FIGS. 7*a* and 7*b* may be obtained.

FIGS. 14*a* and 14*b* show another optional embodiment of an applicator 201 comprising two opposed pairs P, S and P', S' of sheets of bristles 2, 3. The two opposed pairs of sheets of bristles pass through the support 4. The support 4 thus forms, on two faces lying opposite each other, two planes of setting 5, 5'. The support 4 comprises a front end 4*a* and a rear end 4*b*. The rear end 4*b* may be joined, as described above, to a wand 10*a*. The support 4 may be provided with two groups of holes 21*a*, 21*b* passing through the support at different angles. At least one bristle 2, 3 passes through each hole 21*a*, 21*b* so as to form V-shaped forks between the bristles on each side of the support 4. Thus, an applicator having two application portions may be defined.

The bristles may be fixed to the support 4, as illustrated in FIG. 14*b*, by swaging the lateral side of the support 4 by means of a suitable tool 50. Under these conditions, the support must be made of a suitable material, for instance a thermoplastic material such as polyethylene or polypropylene.

The applicator 1, 101, 201 may be optionally made by overmolding or injection overmolding a thermoplastic material of substantially rigid or semi-rigid consistency, or an elastomer, such as a thermoplastic elastomer, of suitable flexibility. As an example, the bristles may be cut to the required length and may be held in their desired orientation by means of a clamp. The ends of the bristles projecting from the clamp may then be introduced into a mold, where the support may be formed around the ends of the bristles during the overmolding or injection overmolding operation. It may be possible at the same time to form the wand 10*a* and possibly all or part of the gripping sleeve 10.

It will be apparent to those skilled in the art that various modifications and variations can be mace to the structure and methodology described herein. Thus, it should be understood that the invention is not limited to the examples discussed in the specification. Rather, the present invention is intended to cover modifications and variations.

What is claimed is:

1. An applicator for applying a product to keratinous fibers, comprising:

an untwisted support defining a longitudinal axis;

a first plurality of bristles arranged in a first sheet and attached to the support; and a second plurality of bristles arranged in a second sheet and attached to the support, wherein at least some of the bristles arranged in the first sheet intersect with at least some of the bristles arranged in the second sheet when the applicator is viewed substantially perpendicularly to the longitudinal axis, and wherein the applicator is configured to apply the product to at least one of eyelashes and eyebrows, and wherein at least some of the bristles arranged in the first sheet and at least some of the bristles arranged in the second sheet comprise bristles that do not define any bristle tuft.

2. The applicator of claim 1, wherein at least some of the bristles arranged in the first and second sheets are arranged to form tufts.

3. The applicator of claim 2, wherein the number of bristles that comprises a tuft ranges from approximately 2 to approximately 200 bristles.

4. The applicator of claim 2, wherein the number of bristles that comprises a tuft ranges from approximately 4 to approximately 100 bristles.

5. The applicator of claim 2, wherein the number of bristles that comprises a tuft ranges from approximately 5 to approximately 50 bristles.

6. The applicator of claim 1, wherein the bristles arranged in the first and second sheets have free ends, and at least some of the bristles of the first sheet intersect at least some of the bristles of the second sheet at a distance spaced from their free ends when the applicator is viewed substantially perpendicularly to the longitudinal axis.

7. The applicator of claim 1, wherein the attachment of the first sheet to the support is separated from the attachment of the second sheet to the support by a non-zero distance.

8. The applicator of claim 1, wherein the first and second sheets are not parallel to each other.

9. The applicator of claim 8, wherein the support defines a mounting surface and the first and second sheets are perpendicularly attached to the mounting surface.

10. The applicator of claim 1, wherein the support defines a mounting surface and at least one of the first and second sheets is obliquely attached to the mounting surface.

11. The applicator of claim 10, wherein the first sheet diverges from the second sheet.

12. The applicator of claim 10, wherein the first sheet converges toward the second sheet.

13. The applicator of claim 12, wherein the first sheet forms a first angle with the second sheet when the applicator is viewed along the longitudinal axis.

14. The applicator of claim 13, wherein the first angle ranges from approximately 15° to approximately 165°.

15. The applicator of claim 12, wherein the bristles arranged in the first and second sheets have free ends and the first sheet intersects the second sheet along at least one line of intersection located at a distance spaced from the free ends when the applicator is viewed along the longitudinal axis.

16. The applicator of claim 1, further comprising a third plurality of bristles arranged in a third sheet and attached to the support.

17. The applicator of claim 16, wherein the first sheet is substantially parallel to the second sheet and the third sheet intersects at least one of the first sheet and the second sheet when the applicator is viewed along the longitudinal axis.

18. The applicator of claim 1, wherein the bristles arranged in the first sheet are substantially parallel to each other and the bristles arranged in the second sheet are substantially parallel to each other.

19. The applicator of claim 1, wherein the bristles within at least one of the first sheet and the second sheet are arranged so that the bristle density at a first portion of the sheet varies from the bristle density at a second portion of the sheet.

20. The applicator of claim 1, wherein the first sheet has a first height and a first length and the second sheet has a second height and a second length, and the first height differs from the second height over at least a portion of the first and second lengths.

21. The applicator of claim 1, wherein at least one of the first sheet and the second sheet has a height and a length, and the height varies over at least a portion of the length.

22. The applicator of claim 1, wherein the height varies progressively.

23. The applicator of claim 1, wherein the support comprises at least two parts.

24. The applicator of claim 23, wherein the at least two parts are joined together by one of snap-fastening, welding, and bonding.

25. The applicator of claim 1, wherein at least one of the first sheet and the second sheet passes through the support and extends from two sides of the support.

26. The applicator of claim 1, wherein at least a portion of the first plurality of bristles comprise asperities configured to facilitate the attachment of the bristles to the support.

27. The applicator of claim 1, wherein the first plurality of bristles defines a first angle in a plane of the first sheet with the support, the second plurality of bristles defines a second angle in a plane of the second sheet with the support, and the first angle differs from the second angle.

28. The applicator of claim 27, wherein the first angle and the second angle each range from approximately 30° to approximately 150°.

29. The applicator of claim 1, wherein at least the first plurality of bristles comprises at least one of a polyethylene bristle, a polypropylene bristle, an ethylene/propylene copolymer bristle, a polyamide bristle, a polyester bristle, a polyvinyl chloride bristle, a polytetrafluoroethylene bristle, a polyethylene terephthalate bristle, a thermoplastic elastomer bristle, and a mixture of one or more of such bristles.

30. The applicator of claim 1, wherein the cross section of each of the bristles of at least a portion of the first plurality of bristles is circumscribed by a circle of diameter ranging from approximately 0.08 mm to approximately 0.20 mm.

31. The applicator of claim 1, wherein each of the bristles of at least a portion of the first plurality of bristles have cross sections of a first shape, and each of the bristles of at least another portion of the first plurality of bristles have cross sections of a second shape differing from the first shape.

32. The applicator of claim 1, wherein the part of the bristles extending beyond the support of at least a portion of the first plurality of bristles has a length ranging from approximately 0.5 mm to approximately 20 mm.

33. The applicator of claim 1, wherein the part of the bristles extending beyond the support of at least a portion of the first plurality of bristles has a length ranging from approximately 1 mm to approximately 10 mm.

34. The applicator of claim 1, wherein each of at least some of the bristles have a free end and the shape of the free end is chosen from one of a rounded shape, a tapered shape, a forked shape, pinheaded shape, and a hooked shape.

35. The applicator of claim 1, wherein the applicator is made by one of overmolding the support around the first and the second plurality of bristles and injection overmolding the support around the first and the second plurality of bristles.

36. The applicator of claim 35, wherein the overmolding material is a thermoplastic.

37. The applicator of claim 1, wherein the support comprises a substantially planar mounting surface.

38. An applicator for applying a product to keratinous fibers, comprising:

an untwisted support defining a longitudinal axis;

a first plurality of bristles arranged in a first sheet and attached to the support; and a second plurality of bristles arranged in a second sheet and attached to the support, wherein at least some of the bristles arranged in the first sheet intersect with at least some of the bristles arranged in the second sheet when the applicator is viewed substantially perpendicularly to the longitudinal axis, wherein the applicator is configured to apply the product to at least one of eyelashes and eyebrows, and wherein at least some of the bristles of the first sheet intersect with at least some of the bristles of the second sheet when the applicator is viewed along the longitudinal axis.

39. An applicator for applying a product to keratinous fibers, comprising:

an untwisted support defining a longitudinal axis;

a first plurality of bristles arranged in a first sheet and attached to the support; and a second plurality of bristles arranged in a second sheet and attached to the support, wherein at least some of the bristles arranged in the first sheet intersect with at least some of the bristles arranged in the second sheet when the applicator is viewed substantially perpendicularly to the longitudinal axis, wherein the applicator is configured to apply the product to at least one of eyelashes and eyebrows, and wherein the first and second sheets are substantially parallel to each other.

40. An applicator for applying a product to keratinous fibers, comprising:

an untwisted support defining a longitudinal axis;

a first plurality of bristles arranged in a first sheet and attached to the support; and a second plurality of bristles arranged in a second sheet and attached to the support, wherein at least some of the bristles arranged in the first sheet intersect with at least some of the bristles arranged in the second sheet when the applicator is viewed substantially perpendicularly to the longitudinal axis, wherein the applicator is configured to apply the product to at least one of eyelashes and eyebrows, and wherein at least some of the bristles of the first sheet and at least some of the bristles of the second sheet contact each other.

41. An applicator for applying a product to keratinous fibers, comprising:

an untwisted support defining a longitudinal axis;

a first plurality of bristles arranged in a first sheet and attached to the support; and a second plurality of bristles arranged in a second sheet and attached to the support, wherein at least some of the bristles arranged in the first sheet intersect with at least some of the bristles arranged in the second sheet when the applicator is viewed substantially perpendicularly to the longitudinal axis, wherein the support comprises at least two parts, and wherein the at least two parts are linked by a film hinge.

42. An applicator for applying a product to keratinous fibers, comprising:

an untwisted support defining a longitudinal axis;

a first plurality of bristles arranged in a first sheet and attached to the support; and a second plurality of bristles arranged in a second sheet and attached to the support, wherein at least some of the bristles arranged in the first sheet intersect with at least some of the bristles arranged in the second sheet when the applicator is viewed substantially perpendicularly to the longitudinal axis, wherein the applicator is configured to apply the product to at least one of eyelashes and eyebrows, and wherein at least one bristle from the first and second pluralities of bristles is chosen from one of a natural bristle and a synthetic bristle.

43. An applicator for applying a product to keratinous fibers, comprising:

an untwisted support defining a longitudinal axis;

a first plurality of bristles arranged in a first sheet and attached to the support; and a second plurality of bristles arranged in a second sheet and attached to the support, wherein at least some of the bristles arranged in the first sheet intersect with at least some of the bristles arranged in the second sheet when the applicator is viewed substantially perpendicularly to the longitudinal axis, wherein the applicator is configured to apply the product to at least one of eyelashes and eyebrows, and wherein the material of which at least one bristle is made contains a slip agent to improve the slip of the bristle over the keratinous fibers.

44. The applicator of claim 43, wherein the slip agent is chosen from one of a graphite, a molybdenum disulphide, and a polytetrafluoroethylene.

45. An applicator for applying a product to keratinous fibers, comprising:

an untwisted support defining a longitudinal axis;

a first plurality of bristles arranged in a first sheet and attached to the support; and a second plurality of bristles arranged in a second sheet and attached to the support, wherein at least some of the bristles arranged in the first sheet intersect with at least some of the bristles arranged in the second sheet when the applicator is viewed substantially perpendicularly to the longitudinal axis, wherein the applicator is configured to apply the product to at least one of eyelashes and eyebrows, and wherein the cross section of each of the bristles of at least a portion of the first plurality of bristles is circumscribed by a circle of diameter ranging from approximately 0.06 mm to approximately 0.30 mm.

46. An applicator for applying a product to keratinous fibers, comprising:

a support defining a longitudinal axis, the support lacking twisted wire branches;

a first plurality of bristles arranged in a first sheet and attached to the support; and a second plurality of bristles arranged in a second sheet and attached to the support, wherein at least some of the bristles arranged in the first sheet intersect with at least some of the bristles arranged in the second sheet when the applicator is viewed substantially perpendicularly to the longitudinal axis, wherein the applicator is configured to apply the product to at least one of eyelashes and eyebrows, and wherein at least some of the bristles arranged in the first sheet and at least some of the bristles arranged in the second sheet comprise bristles that do not define any bristle tuft.

47. The applicator of claim 46, wherein at least some of the bristles arranged in the first and second sheets are arranged to form tufts.

48. The applicator of claim 46, wherein at least some of the bristles of the first sheet intersect with at least some of the bristles of the second sheet when the applicator is viewed along the longitudinal axis.

49. The applicator of claim 46, wherein the first and second sheets are not parallel to each other.

50. The applicator of claim 46, wherein the support defines a mounting surface and at least one of the first and second sheets is obliquely attached to the mounting surface.

51. The applicator of claim 50, wherein the first sheet converges toward the second sheet.

52. The applicator of claim 46, further comprising a third plurality of bristles arranged in a third sheet and attached to the support.

53. The applicator of claim 46, wherein at least one of the first sheet and the second sheet passes through the support and extends from two sides of the support.

54. The applicator of claim 46, wherein the applicator is made by one of overmolding the support around the first and the second plurality of bristles and injection overmolding the support around the first and the second plurality of bristles.

55. The applicator of claim 46, wherein the support comprises a substantially planar mounting surface.

56. An applicator for applying a product to keratinous fibers, comprising:

a support defining a longitudinal axis, the support lacking twisted wire branches;

a first plurality of bristles arranged in a first sheet and attached to the support; and a second plurality of bristles arranged in a second sheet and attached to the support, wherein at least some of the bristles arranged in the first sheet intersect with at least some of the bristles arranged in the second sheet when the applicator is viewed substantially perpendicularly to the longitudinal axis, wherein the support comprises at least two parts, and wherein the at least two parts are linked by a film hinge.

57. An applicator for applying a product to keratinous fibers, comprising:

a support defining a longitudinal axis, the support being formed of a molded material;

a first plurality of bristles arranged in a first sheet and attached to the support; and a second plurality of bristles arranged in a second sheet and attached to the support, wherein at least some of the bristles arranged in the first sheet intersect with at least some of the bristles arranged in the second sheet when the applicator is viewed substantially perpendicularly to the longitudinal axis, wherein the applicator is configured to apply the product to at least one of eyelashes and eyebrows, and wherein at least some of the bristles arranged in the first sheet and at least some of the bristles arranged in the second sheet comprise bristles that do not define any bristle tuft.

58. The applicator of claim 57, wherein at least some of the bristles arranged in the first and second sheets are arranged to form tufts.

59. The applicator of claim 57, wherein at least some of the bristles of the first sheet intersect with at least some of the bristles of the second sheet when the applicator is viewed along the longitudinal axis.

60. The applicator of claim 57, wherein the first and second sheets are not parallel to each other.

61. The applicator of claim 57, wherein the support defines a mounting surface and at least one of the first and second sheets is obliquely attached to the mounting surface.

62. The applicator of claim 61, wherein the first sheet converges toward the second sheet.

63. The applicator of claim 57, further comprising a third plurality of bristles arranged in a third sheet and attached to the support.

64. The applicator of claim 57, wherein at least one of the first sheet and the second sheet passes through the support and extends from two sides of the support.

65. The applicator of claim 57, wherein the applicator is made by one of overmolding the support around the first and the second plurality of bristles and injection overmolding the support around the first and the second plurality of bristles.

66. The applicator of claim 57, wherein the support comprises a substantially planar mounting surface.

67. An applicator for applying a product to keratinous fibers, comprising:

a support defining a longitudinal axis, the support being formed of a molded material;

a first plurality of bristles arranged in a first sheet and attached to the support; and a second plurality of bristles arranged in a second sheet and attached to the support, wherein at least some of the bristles arranged in the first sheet intersect with at least some of the bristles arranged in the second sheet when the applicator is viewed substantially perpendicularly to the longitudinal axis, wherein the support comprises at least two parts, and wherein the at least two parts are linked by a film hinge.

68. An applicator device comprising:

an applicator for applying a product to keratinous fibers, the applicator comprising:

an untwisted support defining a longitudinal axis;

a first plurality of bristles arranged in a first sheet and attached to the support; and a second plurality of bristles arranged in a second sheet and attached to the support, wherein at least some of the bristles arranged in the first sheet intersect with at least some of the bristles arranged in the second sheet when the applicator is viewed substantially perpendicularly to the longitudinal axis, and wherein the applicator is configured to apply the product to at least one of eyelashes and eyebrows;

an element having a gripping surface; and a wand having a first end coupled to the element and a second end coupled to the applicator.

69. The applicator device of claim 68, wherein the element is configured to reversibly close an opening of a container.

70. A system for applying a product to keratinous fibers, comprising:

the applicator device of claim 68; and a container for containing the product.

71. The system of claim 70, wherein the container defines an opening and the container comprises a wiping member located adjacent the opening.

72. The system of claim 70, further comprising the product, wherein the product is a cosmetic product for applying to at least one of the eyelashes and the eyebrows.

73. The system of claim 70, wherein the product is mascara.

74. A method for applying a product comprising:

providing the system of claim 73;

loading the product onto the applicator; and placing the applicator in contact with a keratinous fiber such that at least some of the product is applied to the fiber.

75. The method of claim 74, further comprising engaging the keratinous fiber in a V-shaped fork formed by the intersection of a bristle from the first sheet and a bristle from the second sheet.

76. The method of claim 75, further comprising flexing the bristles forming the intersection.

77. The method of claim 74, wherein the first plurality of bristles has a height greater than the height of the second plurality of bristles, and further comprising drawing the keratinous fiber past the first plurality of bristles so as to separate the keratinous fiber from adjacent keratinous fibers.

* * * * *